US011299830B2

(12) United States Patent
Zheng

(10) Patent No.: US 11,299,830 B2
(45) **Date of Patent: *Apr. 12, 2022**

(54) KNITTING NEEDLE WITH SWIVEL JOINT

(71) Applicant: Westing Bridge LLC, Troy, MI (US)

(72) Inventor: Liyun Zheng, Troy, MI (US)

(73) Assignee: Westing Bridge LLC, Troy, MI (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/070,549

(22) Filed: Oct. 14, 2020

(65) Prior Publication Data

US 2021/0087723 A1 Mar. 25, 2021

Related U.S. Application Data

(63) Continuation-in-part of application No. 16/601,009, filed on Oct. 14, 2019, now Pat. No. 11,060,216, which is a continuation-in-part of application No. 15/992,572, filed on May 30, 2018, now Pat. No. 10,443,164.

(51) Int. Cl.
*D04B 3/02* (2006.01)

(52) U.S. Cl.
CPC ..... *D04B 3/02* (2013.01)

(58) Field of Classification Search
CPC ..... D04B 3/00; D04B 3/02
USPC ..... 66/121, 123, 116, 117
See application file for complete search history.

(56) References Cited

U.S. PATENT DOCUMENTS

| | | | | |
|---|---|---|---|---|
| 1,989,352 A | | 1/1935 | Davis | |
| 2,043,958 A | | 6/1936 | Engel | |
| 2,102,600 A | * | 12/1937 | Miller | D04B 3/02 66/117 |
| 2,183,791 A | * | 12/1939 | Dunn | D04B 3/02 66/117 |

(Continued)

FOREIGN PATENT DOCUMENTS

| | | |
|---|---|---|
| CN | 2514012 Y | 10/2002 |
| DE | 20117288.7 U1 | 2/2003 |
| GB | 404798 A | 1/1934 |

OTHER PUBLICATIONS

Abbey, Barbara, "The Complete Book of Knitting", Dover Publications, https://books.google.com/books?id=CfbilcoTz6YC, Apr. 1, 2001.

*Primary Examiner* — Danny Worrell
(74) *Attorney, Agent, or Firm* — Haley Guiliano LLP; Stefan D. Osterbur

(57) ABSTRACT

A knitting needle or knitting needle assembly may include a cable having opposite ends, with first and second cylindrical members coupled to the opposite ends, respectively. At least one of the first and second cylindrical members may be coupled to its respective end of the cable such that the cylindrical member swivels about its longitudinal axis with respect to the cable to permit relative rotation between the respective cylindrical member and the cable. One or both cylindrical members may define a cavity generally enclosing its respective cable end. Alternatively or in addition, one or both cylindrical member may define a first end bore receiving the cable, and a second end bore at an opposite end thereof, with the second end bore defining a radially inwardly facing thread configured to mate with a radially outwardly facing thread of the cable.

20 Claims, 11 Drawing Sheets

(56) References Cited

U.S. PATENT DOCUMENTS

| | | | | | |
|---|---|---|---|---|---|
| 2,208,124 | A * | 7/1940 | Dunn | D04B 3/02 | 66/117 |
| 2,242,880 | A * | 5/1941 | Dunn | D04B 3/02 | 66/117 |
| 2,507,174 | A * | 5/1950 | Phillips | D04B 3/00 | 66/118 |
| 3,540,452 | A | 11/1970 | Usher et al. | | |
| 4,108,701 | A | 8/1978 | Stanley | | |
| 4,501,133 | A | 2/1985 | Kretzschmar et al. | | |
| 4,646,543 | A * | 3/1987 | Okada | D04B 3/02 | 66/117 |
| 5,211,710 | A | 5/1993 | Nagano | | |
| 5,303,498 | A | 4/1994 | Yutori et al. | | |
| 5,720,187 | A * | 2/1998 | Matuo | D04B 3/02 | 66/117 |
| 6,397,640 | B1 * | 6/2002 | Williams | D04B 3/02 | 66/117 |
| 6,668,597 | B2 * | 12/2003 | Robinson | D04B 3/02 | 66/118 |
| 8,181,489 | B2 | 5/2012 | Selter | | |
| 8,210,003 | B2 * | 7/2012 | Zheng | D04B 3/02 | 66/117 |
| 10,443,164 | B1 | 10/2019 | Zheng et al. | | |
| 11,060,216 | B2 * | 7/2021 | Zheng | D04B 3/02 | |
| 2012/0118021 | A1 | 5/2012 | Zheng | | |
| 2019/0284736 | A1 | 9/2019 | Zheng et al. | | |
| 2020/0040494 | A1 | 2/2020 | Zheng | | |
| 2021/0087723 | A1 | 3/2021 | Zheng | | |

* cited by examiner

KNITTING NEEDLE WITH SWIVEL JOINT

CROSS-REFERENCE TO RELATED APPLICATIONS

This application is a continuation-in-part of U.S. patent application Ser. No. 16/601,009, filed on Oct. 14, 2019, which is a continuation-in-part of U.S. patent application Ser. No. 15/992,572, filed on May 30, 2018, which issued as U.S. Pat. No. 10,443,164. The contents of each of these applications are hereby expressly incorporated by reference in their entireties.

BACKGROUND

A circular knitting needle generally includes two needle members joined by a flexible cable. When used in knitting, one or both needle members may be rotated or turned, applying torque to the flexible cable and eventually causing the flexible cable to twist or wind up. Twisting of the cable may make knitting more difficult, requiring one or both needles to be released from the user's hand(s) to allow the cable to be unwound or straightened.

While some knitting needles have been developed with a swivel joint, there is a need for a swivel joint that allows for a secure connection of the needle member to the cable while still allowing the cable to rotate relatively freely with respect to the needle member.

BRIEF DESCRIPTION OF THE DRAWINGS

Referring now to the drawings, exemplary illustrations are shown in detail. Although the drawings represent some examples, the drawings are not necessarily to scale and certain features may be exaggerated, removed, or partially sectioned to better illustrate and explain the present invention. Further, the exemplary illustrations set forth herein are not intended to be exhaustive or otherwise limit or restrict the claims to the precise forms and configurations shown in the drawings and disclosed in the following detailed description:

FIG. 7A is a side view of a stopper;

FIG. 7B is an end view of the stopper of FIG. 7A;

FIG. 7C is a section view of a cable end;

FIG. 7D is a section view of a cylindrical member or connector member;

FIG. 7E illustrates the cable end of FIG. 7C assembled to a cable, with the cable inserted into the cylindrical member of FIG. 7D and the stopper of FIGS. 7A and 7B inserted into the cylindrical member, according to one example approach; and FIG. 7F illustrates another example cylindrical member or connector member for use in the knitting needle assembly of FIG. 7E;

FIG. 8A is a section view of a cable end stopper, according to an example;

FIG. 8B is a section view of a cable end stopper, according to another example;

FIG. 8C is a section view of a cylindrical member or connector member;

FIG. 8D illustrates the cable end stopper of FIG. 8A assembled to a cable, with the cable inserted into the cylindrical member of FIG. 8C, according to one example approach;

FIG. 8E illustrates the cable end stopper of FIG. 8B assembled to a cable, with the cable inserted into the cylindrical member of FIG. 8C, according to one example approach; and FIG. 8F illustrates another example cylindrical member or connector member for use in the knitting needle assembly of FIG. 8D and/or FIG. 8E.

DETAILED DESCRIPTION

Figure 1:
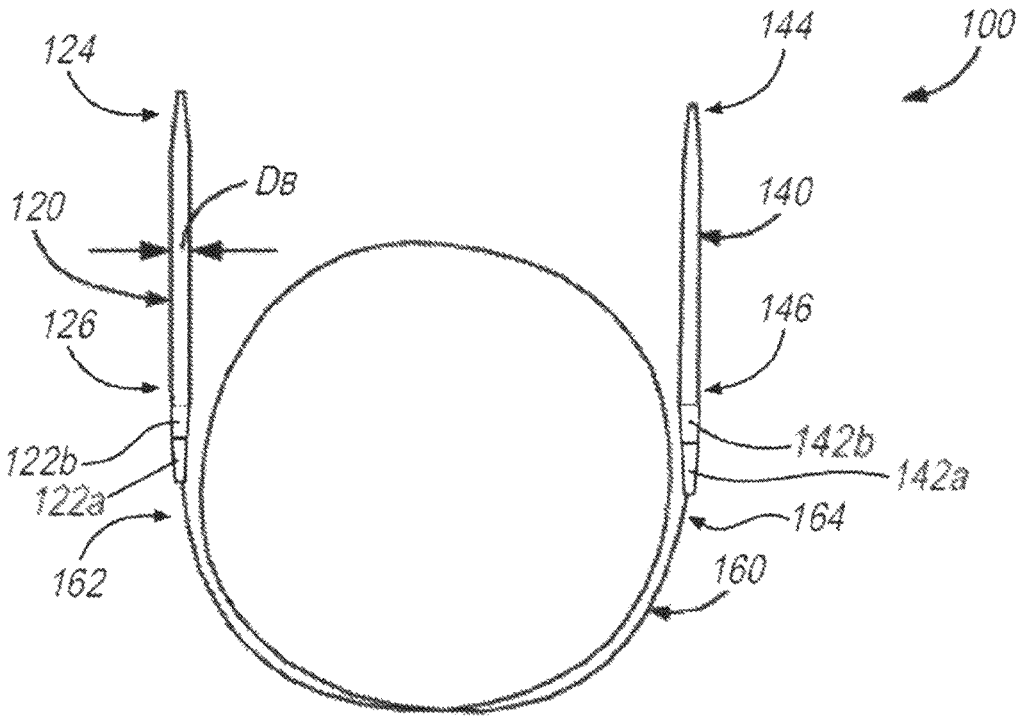
FIG. 1 is a top view of a circular knitting needle including two needle members, with each secured to a flexible cable by way of respective swivel connectors, according to an example approach.

Example embodiments will now be described more fully with reference to the accompanying drawings. Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

When an element or layer is referred to as being "on," "engaged to," "connected to" or "coupled to" another element or layer, it may be directly on, engaged, connected or coupled to the other element or layer, or intervening elements or layers may be present. In contrast, when an element is referred to as being "directly on," "directly engaged to," "directly connected to" or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Example illustrations are provided below of a knitting needle, e.g., a circular knitting needle, which provides connectors for needle members that facilitate relative rotation of the needle members while securely maintaining the needle members axially relative to the cable. Example knitting needles may have one or more needle members having a tip end and a connector end opposite the tip end, with the needle member(s) having a longitudinal axis extending between the tip end and the connector end thereof. The knitting needle may further include a cable having opposite ends, with one of the ends coupled to the connector end of the needle member. The end of the cable may be coupled to the connector end of the needle member with a selectively lockable swivel connector. The selectively lockable swivel connector may include a first connector member defining a bore, a second connector member received in the bore, and a radially resilient locking member disposed about the second connector member and received in the bore. The radially resilient locking member may define first and second annular faces at opposite ends of the locking member, respectively. One of the annular faces of the locking member may engage a corresponding connector annular surface of the first connector member to prevent disengagement of the second connector member from the bore of the first connector member, while also permitting relative rotation between the first and second connector members.

In another example illustration, a knitting needle or knitting needle assembly may include a braided metal cable having opposite ends, with the cable including a plurality of metal braids surrounded by a cover portion, and the cover portion formed of a non-metallic material. First and second cylindrical members, such as connector members for a needle member, may also be provided that are coupled to first and second opposite ends of the cable, with each of the cylindrical members having a respective longitudinal axis extending along a cylindrical body thereof. At least one of the first and second cylindrical members may be coupled to its respective end of the cable such that the cylindrical member swivels about its longitudinal axis with respect to the cable to permit relative rotation between the respective cylindrical member and the cable. Additionally, this cylindrical member may define a first radially extending surface that prevents axial translation of the cable with respect to the cylindrical member while permitting relative rotation of the cylindrical member about the cable.

Further example illustrations are directed to a knitting needle assembly, e.g., for use with or as a knitting needle, which includes a cable coupled to first and second cylindrical members at opposite ends thereof. The first and second cylindrical members may each have a longitudinal axis extending along a cylindrical body thereof. One or both of the cylindrical members may be coupled to its respective cable end such that the cable end is enclosed within a cavity defined in part by the cylindrical member, with the cavity defining a clearance about at least a portion of the cable end such that the cylindrical member swivels about its longitudinal axis with respect to the cable to permit relative rotation between the respective cylindrical member and the cable while axially and radially retaining the cable end within the cavity.

In a further example approach, a knitting needle assembly includes a cable and first and second cylindrical members coupled to the cable at opposite ends thereof, with each of the cylindrical members having a respective longitudinal axis extending along a cylindrical body of the respective cylindrical member. One or both of the first and second cylindrical members is coupled to its respective cable end such that the cylindrical member swivels about its longitudinal axis with respect to the cable to permit relative rotation between the respective cylindrical member and the cable while retaining the cable end, with the cylindrical member defining a first end bore receiving the cable, and a second end bore at an opposite end thereof. The second end bore may define a radially inwardly facing thread configured to mate with a radially outwardly facing thread of the cable.

As best seen in FIG. 1, a knitting needle assembly 100 may include first and second needle members 120, 140 connected by a cable 160. While the disclosure is generally directed to knitting needles, in other examples crochet hook assemblies may be employed. Therefore, while discussed in combination with first and second needle members, it is understood that the present disclosure applies equally to arrangements where the first and second needle members 120, 140 are in the form of crochet hooks. As shown in FIG. 1, the knitting needle 100 may be a circular knitting needle, i.e., where the flexible cable 160 may be wrapped in a circular or semi-circular fashion as shown. However, the concepts described herein are not solely limited to circular knitting needles.

The needle members 120, 140, in contrast to the flexible cable 160, may generally be relatively inflexible. In an example, the needle members 120, 140 are each formed of a metallic material, such as stainless steel. As shown in FIG. 1, the size of the needle members 120, 140 may be defined by a laterally extending diameter DB of the needle main body. The needle members 120, 140 may have any longitudinal length that is convenient. Moreover, while the needle members 120, 140 are illustrated with each having the same diameter and length in FIG. 1, in some examples different diameters and/or length needle members may be employed with the cable 160.

The cable 160 may include a braided metal cable formed from metal strands, which strands are covered with a nylon coating. The braided metal cable and nylon coating (not shown) may be sized to accommodate flexibility and crimping, e.g., to a needle connector as will be discussed below.

In one example, a braided metal cable as disclosed in U.S. Pat. No. 8,210,003 is employed.

The needle members 120, 140 may each have a tip end 124, 144, respectively, which may be generally pointed or otherwise configured to facilitate knitting. Connector ends 126, 146 may be disposed opposite the tip ends 124, 144 of each of the needle members 120, 140.

The connector ends 126, 146 may be connected to the cable 160 via respective swivel connectors 122*a*/122*b* (collectively, 122) and 142*a*/142*b* (collectively, 142), respectively. More specifically, the cable 160 may be secured to first connector members 122*a*, 142*a*, at each end thereof. Merely as one example, the first connector members 122*a*, 142*a* may be secured to corresponding ends 162, 164 of the cable 160, respectively, using a crimped connection such as that described in U.S. Pat. No. 8,210,003. Thus, the ends 162, 164 of the cable 160 (including the braided metal cable and the nylon coating thereof) may be located in a bore (not shown in FIG. 1) defined by the respective first connector members 122*a*, 142*a*.

Any size or configuration of the cable 160 may be employed that is convenient. In one example, the cable 160 may include a braided metal cable formed from metal strands, with the strands collectively covered with a nylon coating. The braided metal cable and nylon coating may be sized to accommodate crimping to the first connector members 122*a*, 142*a* and a flexibility of the cable 160, as described in U.S. Pat. No. 8,210,003. In another example, for a needle diameter less than 4.0 millimeters (mm), the cable 160 includes an overall diameter of 1.0 mm to 1.6 mm. The cable 160 may be formed from a relatively large number of metal strands, e.g., 40 to 60 strands, with each of the strands having a diameter between 0.1 mm and 0.15 mm. In other examples, a greater number of strands may be used. Generally, larger numbers of strands may be used where the strands themselves are smaller in diameter, with the increase in number of strands (and smaller diameter of the individual strands) providing increased overall flexibility of the cable 160. The nylon coating may define a wall thickness of 0.2 mm to 0.3 mm, merely as one example.

Figure 2A:
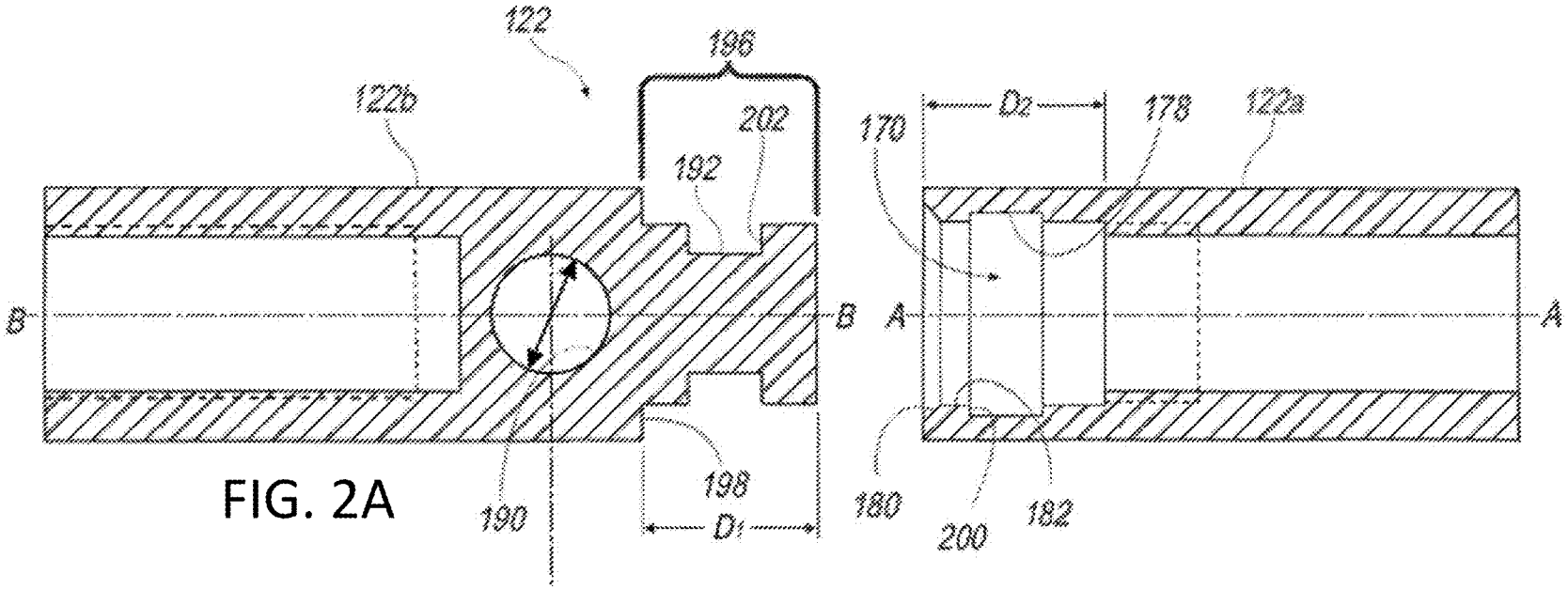
FIG. 2A is an enlarged section view of one of the swivel connectors of FIG. 1 to illustrate first and second connector members and a locking member, according to one example approach.
Figure 2B:
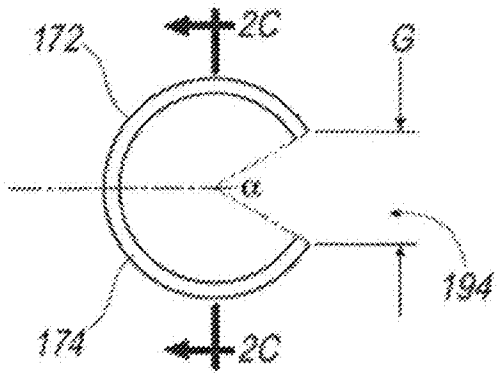
FIG. 2B is a longitudinal or end view of the locking member of FIG. 2A.
Figure 2C:
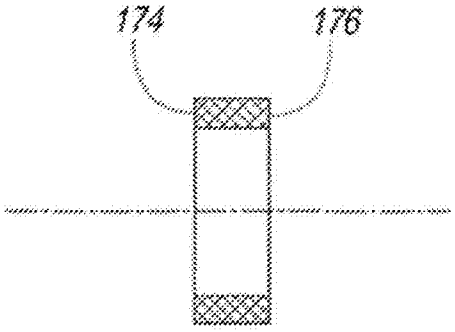
FIG. 2C is a section view of the locking member of FIG. 2B, taken through line 2C-2C.

Turning now to FIGS. 2A-2C, the connectors 122, 142 will be described in further detail. While the following examples are illustrated in connection with swivel connector 122, it is to be understood that in some examples the connector 142 provided at the opposite end of cable 160 may also be a swivel connector. Accordingly, the following description of swivel connector 122 may be equally applicable to the other connector 142. Moreover, in some examples, the connectors 122, 142 may be identical, e.g., with respect to construction, configuration, and/or the manner in which they facilitate swiveling or rotation of the needle members 120/140 with respect to cable 160. Nevertheless, it is not required that both needle members 120, 140 be connected to the cable 160 with swivel connectors, as in some examples only one swivel connector may be needed.

As seen in FIGS. 2A-2C, swivel connector 122 may be a selectively lockable swivel connector that includes a first connector member 122*a* and a second connector member 122*b*. The section view of the first and second connector members 122*a*, 122*b* in FIG. 2A (as well as those in FIGS. 3A-3C referred to below) shows one section of the connector members 122*a*, 122*b*. In some examples, the connector members 122*a*, 122*b* may have an identical section around the entire circumference, or substantially the entire circumference, of the generally cylindrical members 122*a*, 122*b*. Thus, the various annular surfaces described below which are defined by the first and second connector members 122*a*, 122*b* may similarly extend about the entire circumference, or substantially the entire circumference, of the first and second connector members 122*a*, 122*b*.

The first connector member 122*a* defines a bore 170 configured to receive the second connector member 122*b*, as will be discussed further below. Moreover, the first and second connector members 122*a*, 122*b* are configured to permit relative rotation between the two connector members 122*a*, 122*b* when they are fully engaged with each other. In other words, while the second connector member 122*b* is generally fixed axially with respect to the first connector member 122*a* when the two connector members 122*a*, 122*b* are engaged, they may generally be freely rotated relative to each other when engaged. In this manner, any twisting of the needle member(s) 120 and/or 140, e.g., during knitting, is generally not transferred to the cable 160, thereby reducing or preventing twisting or windup of the cable 160.

The second connector member 122*b* may be formed as a separate part from the needle member 120, or may be integrally formed as part of the needle member 120 at the connector end 126 thereof. Where the second connector member 122*b* is a separate part from the needle member 120, the second connector member 122*b* may be secured to the needle member 120 by a threaded connection, or any other method that is convenient. To this end, a connector aperture 190 may be provided extending through the second connector member 122*b*, which may facilitate gripping the second connector member 122*b* to the extent necessary to secure a threaded connection with the associated needle member 120.

The swivel connector 122 further includes a radially resilient locking member 172 which is illustrated in FIGS. 2B and 2C. As will be described further below, the locking member 172 may be disposed about the second connector member 122*b* and may prevent the disengagement of the first and second connector members 122*a*, 122*b* when assembled. In one example, the radially resilient locking member may be a generally c-shaped ring defining an annular gap, which may generally facilitate assembly of the locking member 172 onto the second connector member 122*b*. The radially resilient locking member 172 may define a first annular face 174 and a second annular face 176, which are disposed at opposite ends of the locking member 172, respectively. In one example, the locking member 172 is formed of a metallic material, e.g., stainless steel. The locking member 172 may resiliently deflect to facilitate assembly of the first and second connector members 122*a*, 122*b* together, as will be described further below.

Turning back to FIG. 2A, the bore 170 of the first connector member 122*a* may define a radially outer cavity 178, which faces radially inwardly within the bore 170 and, as will be described further below, is configured to receive the radially resilient locking member when the second connector member is fully inserted into the bore 170. The bore 170 may also define a radially inwardly extending ramp 180 defining an oblique angle with respect to a longitudinal axis A-A of the bore 170. The ramp 180 may be a chamfer positioned at the end of the first connector member 122*a*, which generally guides insertion of the second connector member 122*b* into the bore 170. Additionally, the oblique angle of the ramp 180 with respect to the axis A-A may generally urge the radially resilient locking member 172 radially inwardly when the second connector member 122*b* is inserted into the bore 170, as will be discussed further below. The oblique angle of the ramp 180 with respect to the axis A-A of the bore 170 may be 45 degrees, as illustrated in FIG. 2A, however any angle that is convenient may be employed. The bore 170 may also define a cylindrical lip 182. The cylindrical lip 182 may extend from the ramp 180 to the radially inwardly facing groove 178.

Figure 3B:
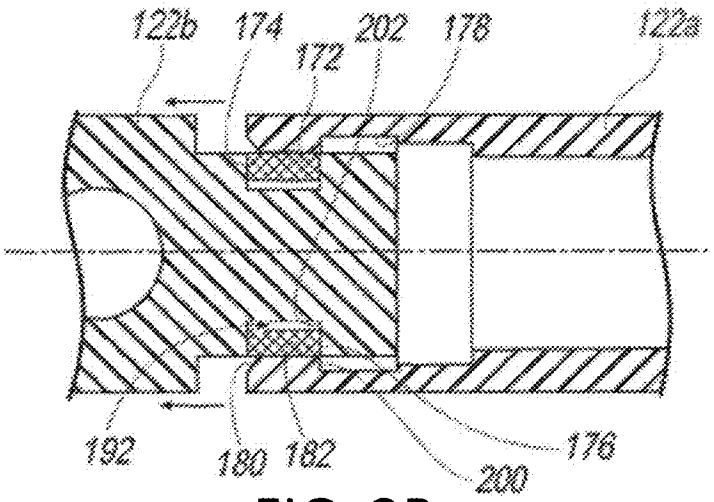
FIG. 3B is a section view of the first and second connector members and locking member of FIG. 3A, showing the second connector member as it is inserted further into the bore of the first connector member.
Figure 3A:
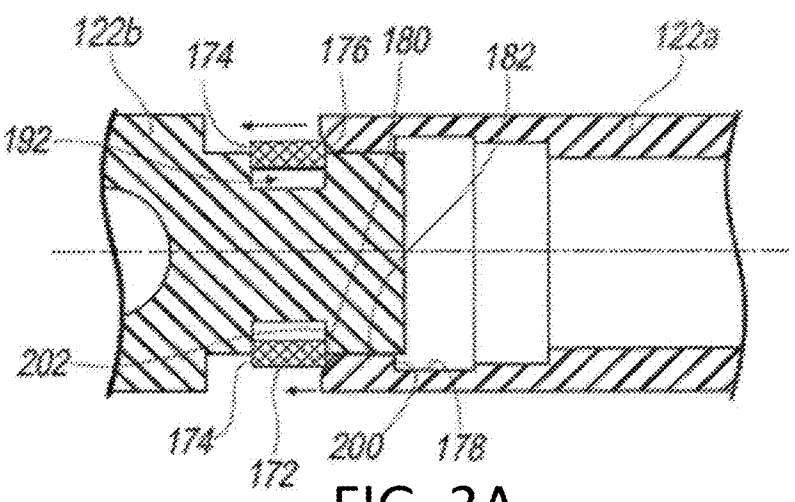
FIG. 3A is a section view of the first and second connector members of FIG. 2A and the locking member of FIGS. 2B and 2C, showing the second connector member just before insertion into a bore of the first connector member.
Figure 3C:
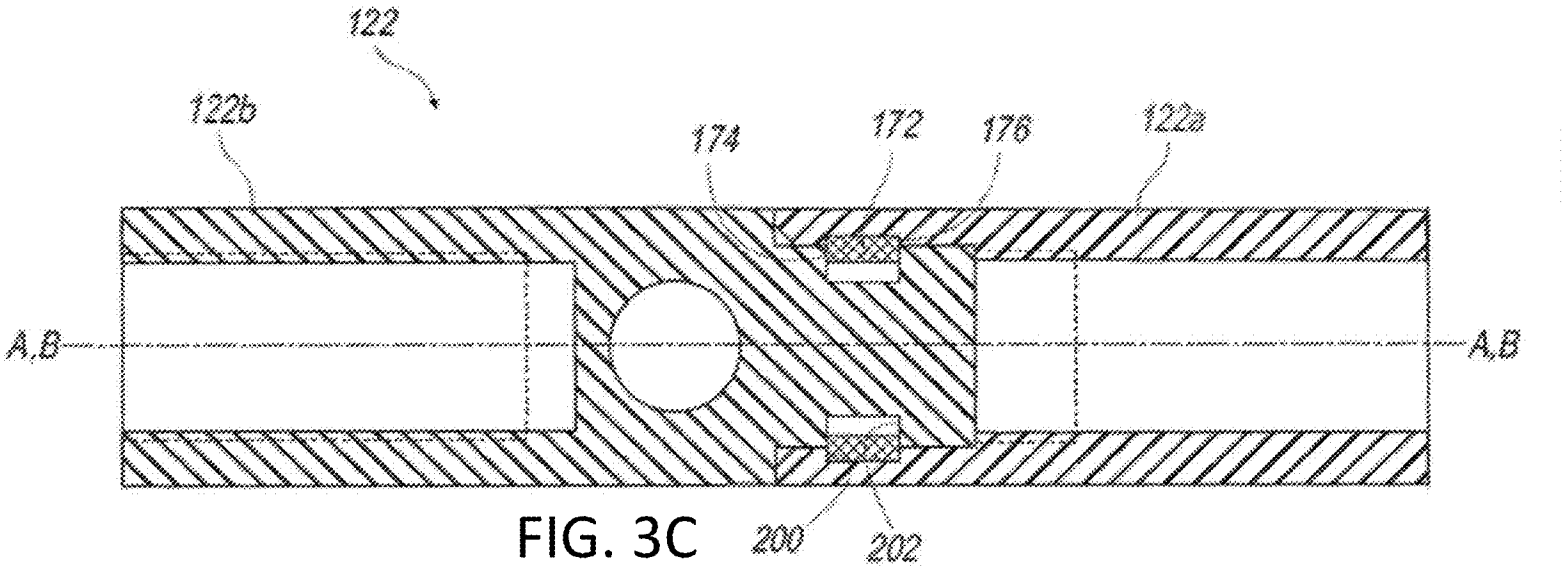
FIG. 3C is a section view of the first and second connector members and locking member of FIGS. 3A and 3B, showing the second connector member after it is fully inserted into the bore of the first connector member.

Turning now to FIGS. 3A-3C, the assembly of the first and second connector members 122*a*, 122*b* will be described in further detail. As best seen in FIG. 3A, the locking member 172 may initially be placed around the second connector member 122*b*. For example, the locking member 172 may be placed on to the second connector member 122*b* by placing the locking member 172 adjacent an inner groove 192 of the second connector member 122*b*, and forcing the second connector member 122*b* through the annular gap 194. The annular gap 194 may extend a gap distance G that is smaller than a diameter of the second connector member 122*b* at the inner groove 192, such that the locking member 172 is resiliently deflected as it is assembled onto the second connector member 122*b*. Additionally, the smaller magnitude of the gap distance G prevents the locking member 172 from falling off of the second connector member 122*b* (at least in the absence of a force spreading the ends of the locking member 172 sufficiently apart).

The annular gap 194 may be defined by an angular extent of the gap 192 with respect to the generally circular locking member 172. For example, as best seen in FIG. 2B, the annular gap 194 may define an angle $\alpha$. In one example, the angle $\alpha$ is approximately 60 degrees.

With the locking member 172 positioned about the second connector member 122*b*, the second connector member 122*b* may be inserted into the bore 170 until the locking member 172 is brought into contact with the ramp 180 of the bore 170, as shown in FIG. 3A. As the second connector member 122*b* is inserted further into the bore 170, the ramp 180 generally squeezes the locking member 172 radially inward (the ends of the locking member 172 defining the annular gap 194 may be brought closer together as a result of this squeezing). Moreover, the ramp 180 may generally facilitate a relatively smooth insertion and connection of the first and second connector members 122*a*, 122*b* by way of the ramp 180 gradually squeezing the locking member 172 as the locking member 172 is moved axially along the ramp 180. The second connector member 122*b* is inserted further, as shown in FIG. 3B, with the locking member 172 eventually fitting within the cylindrical lip 182 of the bore 170. The cylindrical lip 182 may be cylindrical in shape, as shown.

The locking member 172 may generally slide along the cylindrical lip 182 as the second connector member 122*b* is inserted further into the bore 170 of the first connector member 122*a*, until the locking member 172 reaches the radially inwardly facing groove 178. As best seen in FIG. 3C, upon reaching this axial position the locking member 172 may spring radially outwardly, fitting at least partially into the radially inwardly facing groove 178 of the first connector member 122*a*. In one example, as best seen in FIGS. 3A and 3C, the second connector member 122*a* may have a narrowed portion 196 which defines an axial protrusion $D_1$. This axial protrusion $D_1$ may correspond to an axial depth $D_2$ of the bore 170. As the narrowed portion 196 is fully inserted into the bore 170, the end of the first connector member 122*a* is brought into contact with shoulder 198 of the second connector member 122*b*. Accordingly, the second connector member 122*b* is inserted into the bore 170 to a predetermined distance, as defined generally by the axial protrusion $D_1$ of the second connector member 122*b*, as well as the axial depth $D_2$ of the first connector member 122*a*. Upon the insertion of the second connector member 122*b* into the bore 170 to the predetermined distance, the locking member 172 may be seated partially into the radially inwardly facing groove 178.

With the locking member 172 positioned at least partially within the radially inwardly facing groove 178, the annular faces 174, 176 generally prevent relative axial movement of the first and second connector members 122*a*, 122*b*. More specifically, the locking member 172 is seated partially within the radially inwardly facing groove 178 of the first connector member 122*a*, and partially within the inner groove 192 of the second connector member 122*b*. For example, the radially inwardly facing groove 178 of the bore 170 may define a radial depth that is less than a radial thickness of the locking member 172, as best seen in FIG. 3C. The first annular face 174 may be adjacent or in abutting contact with a first connector annular surface 200 defined by the radially inwardly facing groove 178 of the first connector member 122*a*. Similarly, the second annular face 176 of the locking member 172 may be adjacent or in abutting contact with a second connector annular surface 202 of the second connector member 122*b*.

As such, an attempt to disengage the second connector member 122*b* from the bore 170 of the first connector member 122*a* will be generally blocked by the locking member 172, preventing relative axial movement that would otherwise withdraw the second connector member 122*b* from the first connector member 122*a*. More specifically, a force urging the second connector member 122*b* out of the bore 170 would force the second connector annular surface 202 against the second annular face 176 of the locking member 172, forcing the first annular face 174 of the locking member 172 against the first connector annular surface 200 of the first connector member 122*a*.

As shown in FIGS. 3A-3C, the first annular face 174 of the locking member 172 and the first connector annular surface 200 of the first connector member 122*a* may be each be substantially orthogonal to the axis A-A of the bore 170. Accordingly, axial force applied to the second connector member 122*b* that would otherwise withdraw it from the bore 170 is counterbalanced by a substantially equal axial force applied by the first connector annular surface 200 to the first annular face 174 of the locking member 172. Additionally, the axial force applied by the first connector annular surface 200 to the first annular face 174 of the locking member 172 imparts substantially zero radial force to the locking member 172. The substantial lack of a radial component to the forces applied by the first and second connector members 122*a*, 122*b* to the locking member 172 in response to relative axial forces acting upon the first and second connector members 122*a*, 122*b* advantageously maintains the radial position of the locking member 172, i.e., such that it remains partially disposed in both the radially inwardly facing groove 178 of the first connector member 122*a*, as well as the radially outwardly facing inner groove 192 of the second connector member 122*b*.

The second connector member 122*b* may also be restricted from further insertion into the bore 170 upon engagement of the locking member 172 into the radially inwardly facing groove 178 of the first connector member. For example, the end of the first connector member 122*a* may engage the shoulder 198 of the second connector member 122*b*. The locking member 172 itself may also resist axial movement of the second connector member 122*b* into the first connector member 122*a* due to the partial insertion of the locking member 172 into both the radially inwardly facing groove 178 and the inner groove 192 of the second connector member 122*b*.

While the locking member 172 generally maintains the relative axial position of the second connector member 122*b* to the first connector member 122*a*, the second connector member 122*b* may generally freely rotate about its axis B-B relative to the first connector member 122*a*. Accordingly, if needle members 120/130 are turned during knitting, this turning is not transferred to the cable 160, thereby preventing the cable 160 from being wound up or twisted.

Additionally, it should be understood that the outer surfaces of the connector members 122*b*, 122*a* may cooperate to define a relatively smooth outer surface when assembled, thereby facilitating sliding of thread across an interface between the needle members 120/140, the first and second connector members 122*b*, 122*a*, and the cable 160.

While the foregoing description has described the second connector member 122*b* as being inserted into a bore 170 of the first connector member 122*a*, it should be understood that this arrangement may be executed in reverse, i.e., the second connector member 122*b* may instead define a bore receiving the first connector member 122*a*.

Figure 4:
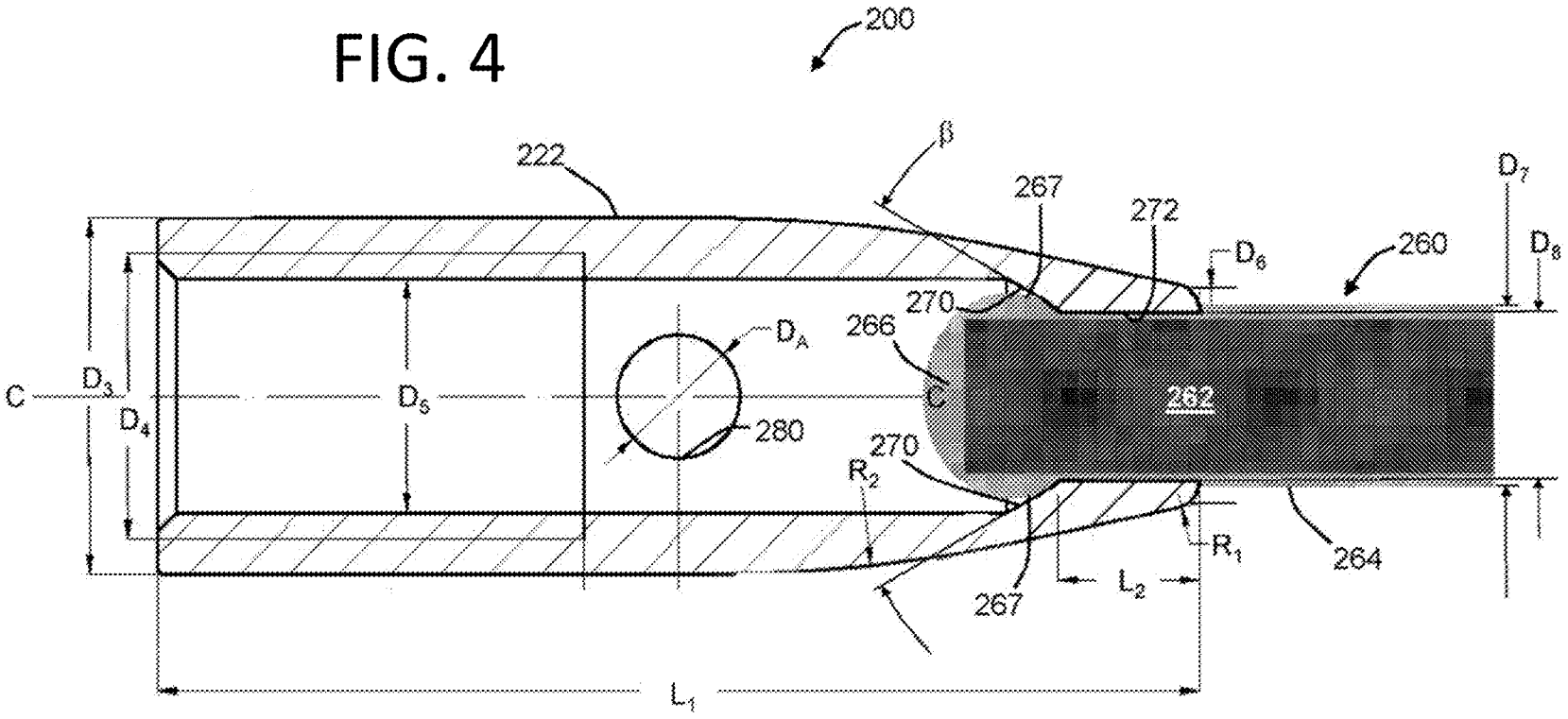
FIG. 4 is a section view of a needle member for a knitting needle, with the needle member secured to a flexible cable to allow swiveling of the needle member with respect to the cable, according to an example.

Turning now to FIG. 4, another knitting needle assembly 200 is illustrated. Knitting needle assembly 200 may include a cable 260 having a connector member 222 at an end thereof. While not illustrated in FIG. 4, an opposite end of cable 260 may have another connector member identical to connector member 222. The connector member(s) 222 may be fixed to a needle having a tip, or may have a needle formed at an end opposite that secured to the cable 260. Thus, the knitting needle assembly 200 may be used for knitting as a circular knitting needle, crochet, etc.

Connector member 222 may have any configuration or dimensions that are convenient. In the example illustrated in FIG. 4, connector member 222 has a generally cylindrical shape having an overall length $L_1$, and an outer diameter $D_3$. The outer diameter $D_3$ may taper to an outer diameter $D_6$ at the end secured to the cable 260. The length $L_1$ and outer diameters $D_3$, $D_6$ may generally be any size that is convenient. The tapering of the cylindrical body of the member 222 may be defined by a radius $R_2$ transitioning from the outer diameter $D_3$ to the narrow end diameter $D_6$. Additionally, a radius $R_1$ may define a further narrowing of an outer surface of the connector member 222 to the bore 272. The sizes of the various diameters, lengths, and radii may be any that is convenient, and as such the connector member 222 may be employed in conjunction with any size or configuration knitting needle members (not shown).

The connector member 222 may be an interchangeable connector member 222, such that a variety of different size/configuration needle members (not shown) may be selectively secured to the connector member 222 and used for knitting. For example, the connector member 222 may have a threaded end opposite that secured to the cable 260. The threaded end has a bore defining an inner diameter D5, with threads having a depth defined by diameter D4. The connector member 222 may have an aperture 280 extending laterally through the connector member 222, which may be used to control or prevent rotation of the connector member 222 while tightening/loosening a needle member from the threaded end of the connector member 222. Merely as an example, a key member (not shown) may be inserted into the aperture 280 and may be used to apply torque to the connector member 222 or hold in a fixed rotational position, thereby allowing tightening/loosening of the connector member 222 from a needle member. The aperture 280 may have a diameter $D_4$, which may be any size that is convenient.

The cable 260 may be a braided metal cable 262 formed from metal strands, which strands are covered with a non-metallic cover portion 264, e.g., a nylon coating. The braided metal cable 262 and cover portion 264 may be sized to accommodate flexibility and crimping, e.g, to a connector. In one example, a braided metal cable as disclosed in U.S. Pat. No. 8,210,003 is employed.

The connector member 222 may swivel or rotate with respect to the cable 260 about a longitudinal axis C-C of the connector member 222. For example, as illustrated in FIG. 4, the end of the cable 260 may be received within the connector member 222. The connector member 222 may have an end bore 272 that is crimped to the end of the cable 260, e.g., using a crimped connection such as that described in U.S. Pat. No. 8,210,003. Thus, the end of the cable 260 may be located in the bore 272 defined by the connector member 222. The connector member 222 may be crimped to the relatively flexible cover portion 264 of the cable 260 such that the connector member 222 is retained axially with respect to the cable 260, but is allowed to rotate or swivel with respect to the cable 260.

In one example, a "controlled crimping" of the connector member 222 to the cable 260 generally crimps the bore 272 of the connector member 222 upon the cover portion 264 to relatively shallow depth within the cover portion 264, thereby allowing the bore 272 of the connector member 222 to slide about the cover portion 264 to facilitate relative rotation of the connector member 222 about the cable 260. The bore 272 extends along a length $L_2$ that is crimped to the cable 260. The controlled crimping of the bore 272 to the cable 260 results in the bore 272 being forced radially inwardly upon the cover portion 264 of the cable 260. More specifically, the cover portion 264 of the cable 260 defines an undeflected outer diameter $D_7$. The bore 272 is crimped upon the cover portion 264, thereby forcing the bore 272 into the cover portion 264 such that the bore 272 defines an inner diameter $D_8$ that is relatively smaller than the undeflected outer diameter $D_7$ of the cover portion 264. The inner diameter $D_8$ may be such that the length $L_2$ of the bore 272 is allowed to rotate about the longitudinal axis C-C of the connector member 222 with respect to the cover portion 264 of the cable 260 to an extent that the connector member 222 is generally free to swivel about the cable 260 during knitting, thereby preventing twisting of the cable 260. Nevertheless, the crimping of the bore 272 upon the cover portion 264 substantially fixes the connector member 222 axially with respect to the cable 260 such that the connector member 222 does not slide axially along the cable 260 during knitting. Any size diameter $D_8$ of the crimped bore 272 may be employed that is convenient to allow relative rotation of the bore 272 about the cover portion 272, while substantially preventing axial movement of the connector member 222 relative to the cable 260. In one example, the diameter $D_8$ is 0.1 millimeters smaller than the undeflected diameter $D_7$ of the cover portion 264, with the thickness of the cover portion 264 being approximately 0.3 millimeters.

The cable 260 may have an enlarged portion or bulb 266 at the end of the cable 260. The bulb 266 may generally cooperate with the controlled crimping of the connector member 222 upon the cable to axially secure the connector member 222 in place upon the cable 260, while permitting relative rotation between the connector member 222 and cable 260. More particularly, the bulb 266 may have a diameter larger than that of the bore 272, thereby preventing the cable 260 from being pulled out of the connector member 222. Additionally, the crimping of the bore 272 upon the cover portion 264 of the cable may generally prevent further axial insertion of the cable 260 into the connector member 222. The connector member 222 may also define a radially extending surface 270 which cooperates with the bulb 266 to retain the cable 260 within the connector member 222. For example, as shown in FIG. 4, if a force is applied to the cable 260 in a direction withdrawing the cable 260 from the connector member 222 (i.e., attempting to move the cable 260 to the right), the bulb 266 engages the radially extending surface 270, thereby obstructing further movement of the cable 260 out of the connector member 222. The radially extending surface 270 also defines an oblique angle β with respect to the longitudinal axis C-C of the connector member 222, with the interior of the connector member 222 narrowing toward the bore 272. In one example, the angle β is 60 degrees with respect to the longitudinal axis C-C. Accordingly, additional force applied to the cable 260 in an attempt to withdraw the cable 260 from the connector member 222 applies a squeezing force to the bulb 266. The bulb 266 may thereby generally prevent withdrawal of the cable 260 from the connector member 222 unless an extremely high force (at least, higher than typical of any passively applied during knitting) is applied to the cable 260.

The bulb 266 thus defines an outer surface 267 extending radially with respect to the longitudinal axis C-C of the connector member 222. The radially extending outer surface 267 may abut the radially extending surface 270 of the connector member 270 to prevent axial movement of the cable 260 that would withdraw the cable 260 from the bore 272. Accordingly, the radially extending surface 267 corresponds to the radially extending surface 270 of the connector member 222, and abuts the radially extending surface 270 to prevent axial withdrawal of the cable 260 from the bore 272. The bore 272, as noted above, may be crimped onto the cover portion 264 of the cable 260, thereby preventing axial movement of the cable 260 in the opposite direction, i.e., such that the cable 260 is generally prevented from moving further into the connector member 222.

The cover bulb 266 may be formed on the cable 260 in any manner that is convenient. In one example approach, the bulb 266 is formed by heating the cover portion 264 and deforming a nylon material thereof into the generally bulb-like shape illustrated in FIG. 4. Initially the cable 260 may be inserted into the bore 272 of the connector member 222 and beyond the radially extending surface 270. Moreover, the cable 260 may be inserted fully through the connector member 222 (i.e., to the left of the connector member 222 in FIG. 4) to allow formation of the bulb 266. Additionally, the inside diameter $D_5$ of the connector member 222 may be large enough to allow the bulb 266 to be withdrawn back into the interior of the connector member 222 after the bulb 266 is formed, with the bulb 266 settling against the radially extending surface 270. Subsequently, the bore 272 may be crimped upon the cover portion 264 of the cable 260 as discussed above.

As noted above, the connector member 222 is illustrated in FIG. 4 for use with an interchangeable needle set. In other words, a variety of different length/diameter needle members (not shown) may be selectively assembled to both connector members 222 to form different size/diameter circular knitting needles. However, application of the concepts described herein is not limited to interchangeable needles. Merely as examples, other variations of connector member 222 are illustrated in FIGS. 5 and 6.

Figure 5:
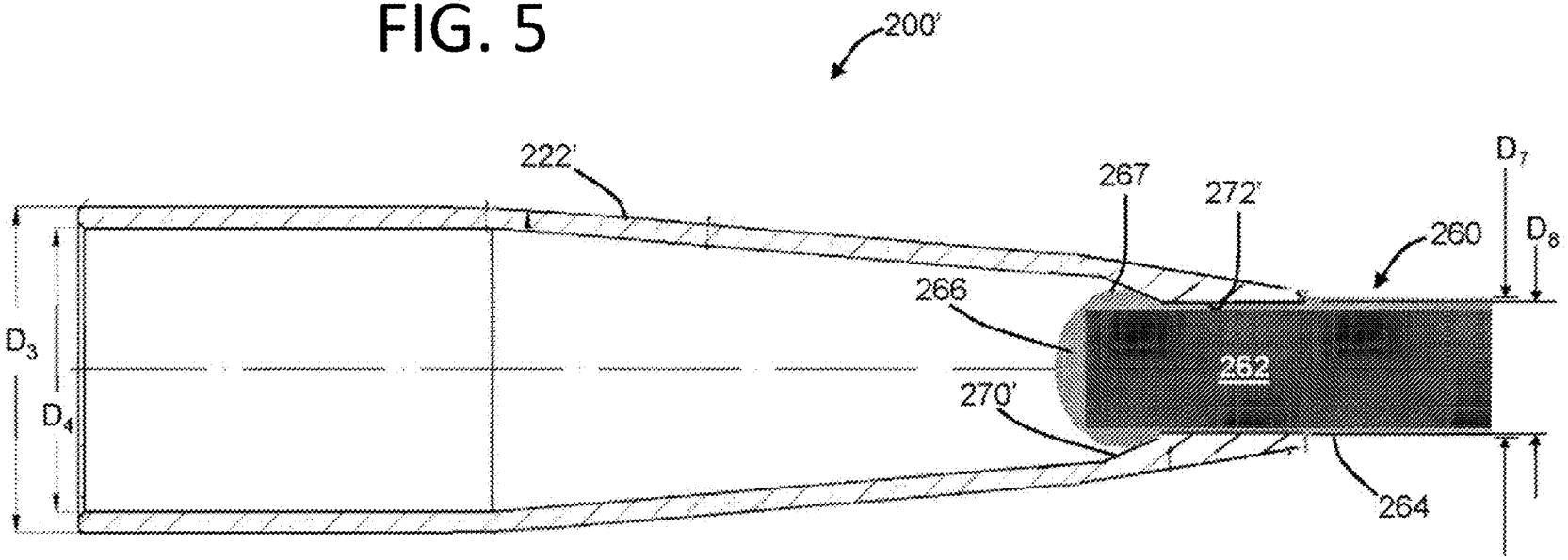
FIG. 5 is a section view of a cylindrical member or connector member for a knitting needle, with the cylindrical member secured to a flexible cable to allow swiveling of the cylindrical member with respect to the cable, according to another example.

More specifically, in FIG. 5 a cylindrical connector member 222' is illustrated for using with a wooden fixed circular knitting needle, which may be inserted into and joined with the connector member 222'. The connector member 222' is illustrated coupled with the cable 260, with the radially extending surface 267 of the bulb 266 engaged or abutted with a radially extending surface 270' of connector member 222'. Additionally, similar to connector member 222, the connector member 222' shown in FIG. 5 includes a bore 272 that is crimped onto the cover portion 264 of the cable 260, e.g., in a controlled crimping process. In other words, the crimping of the bore 272' onto the cover portion 264 of the cable 260 allows the connector member 222' to remain rotatable with respect to the cover portion 264 and cable 260, while being substantially fixed axially with respect to the cable 260.

Figure 6A:
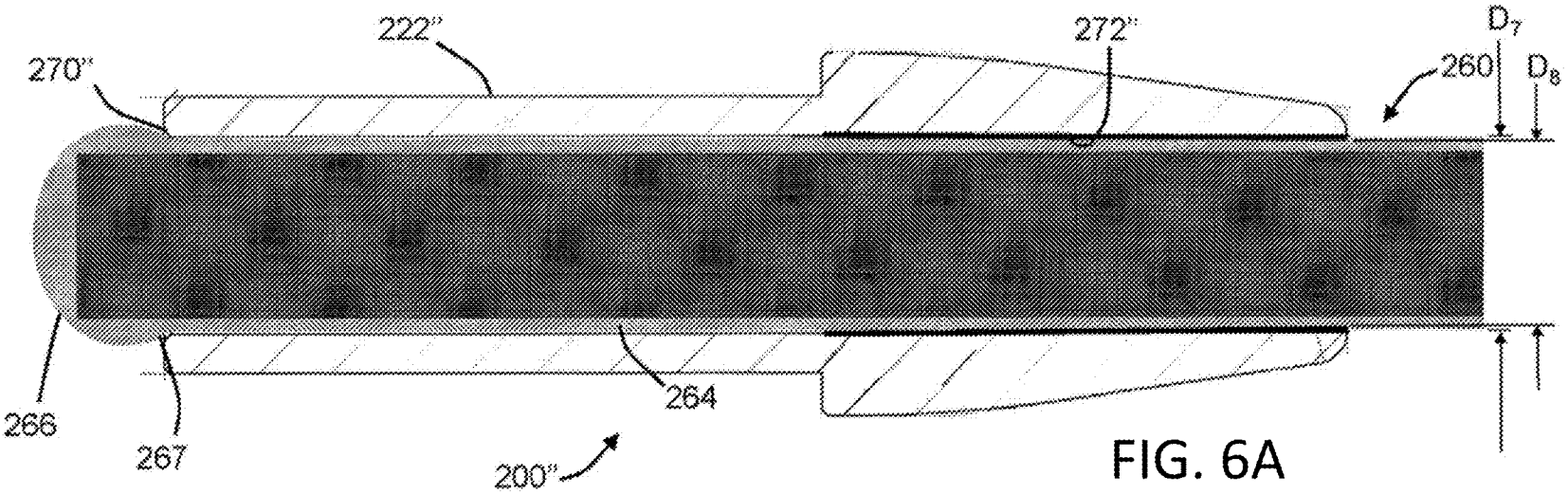
FIG. 6A is a section view of a cylindrical member or connector member for a knitting needle, with the cylindrical member secured to a flexible cable to allow swiveling of the cylindrical member with respect to the cable, according to another example.
Figure 6B:
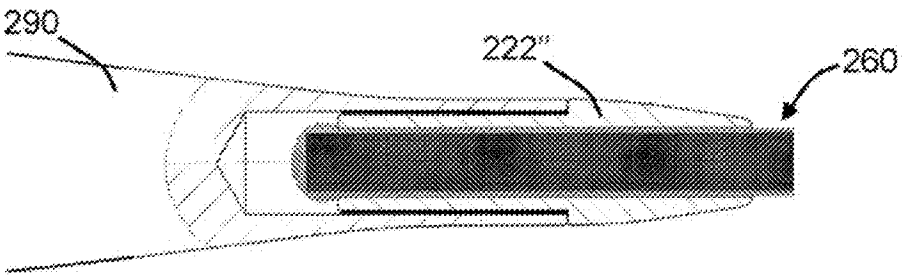
FIG. 6B is a section view of the connector member of FIG. 6A assembled to a needle member, according to an example.

In another example illustrated in FIG. 6, a connector member 222" may be used with solid metal circular knitting needles. As with connector members 222 and 222', the connector member 222" includes a bore 272" that is crimped to the cover portion 264 of the cable 260 to a limited depth, e.g., 0.1 millimeters, such that relative rotation of the connector member 222" about the cable 260 is permitted while axial movement of the connector member 222" with respect to the cable 260 is restricted or prevented entirely. The connector member 222" may have a radially extending surface 270" which abuts radially extending surface 267 of the bulb 266 of the cable 260. The connector member 222 may be inserted into a needle member 290, which as noted above in this example may be a solid metal circular knitting needle.

Turning now to FIGS. 7A, 7B, 7C, 7D, and 7E another knitting needle assembly 300 is illustrated. Knitting needle assembly 300 may include a cable 360 having a connector member 322 at an end thereof. While not illustrated in FIGS. 7A-7E, an opposite end of cable 360 may have another connector member identical to connector member 322. The connector member(s) 322 may be fixed to a needle having a tip, or may have a needle formed at an end opposite that secured to the cable 360. Thus, the knitting needle assembly 300 may be used for knitting as a circular knitting needle, crochet, etc.

As with the foregoing examples, connector member 322 may have any configuration or dimensions that are convenient. In the example approach illustrated in FIGS. 7A-7E, connector member 322 has a generally cylindrical shape having an overall length $L_1$, and an outer diameter $D_7$. The outer diameter $D_7$ may taper to a relatively smaller outer diameter at the end coupled to the cable 360. The length $L_1$, outer diameters, and overall shape and configuration may generally be any that is convenient, and as such the connector member 322 may be employed in conjunction with any size or configuration knitting needle members (not shown).

The connector member 322 may be an interchangeable connector member 322, such that a variety of different size/configuration needle members (not shown) may be selectively secured to the connector member 322 and used for knitting. For example, the connector member 322 may have a threaded end bore 390 opposite the end of the connector member 322 coupled to the cable 360. The threaded end has a bore defining an inner diameter $D_8$, with threads having a depth defined by diameter $D_9$. The connector member 322 may also have an aperture 380 extending laterally through the connector member 322, which may be used to control or prevent rotation of the connector member 322 while tightening/loosening a needle member from the threaded end of the connector member 322. Merely as an example, a key member (not shown) may be inserted into the aperture 380 and may be used to apply torque to the connector member 322 or hold in a fixed rotational position, thereby allowing tightening/loosening of the connector member 322 from a needle member (not shown). The aperture 380 may have a diameter $D_A$, which may be any size that is convenient.

The cable 360 may include a braided metal cable 362 formed from metal strands, which strands are covered with a non-metallic cover portion 364, e.g., a nylon coating. The braided metal cable 362 and cover portion 364 may be sized to accommodate flexibility and crimping, e.g, to a connector. In one example, a braided metal cable as disclosed in U.S. Pat. No. 8,210,003 is employed. The cable 360 may have an overall diameter of 1.0 mm to 1.6 mm. The braided metal cable 362 may be formed from a relatively large number of metal strands, e.g., 40 to 60 strands, with each of the strands having a diameter between 0.1 mm and 0.15 mm. In other examples, a greater number of strands may be used. Generally, larger numbers of strands may be used where the strands themselves are smaller in diameter, with the increase in the number of strands (and smaller diameter of the individual strands) providing increased overall flexibility of the cable 360. The non-metallic cover portion 364 may define a wall thickness of 0.2 mm to 0.3 mm, merely as one example.

Figure 7A:
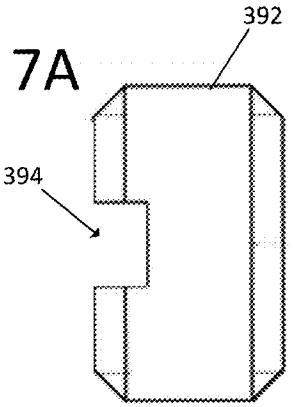
FIGS. 7A-7F illustrate a knitting needle assembly and components thereof, according to an example, where.
Figure 7B:
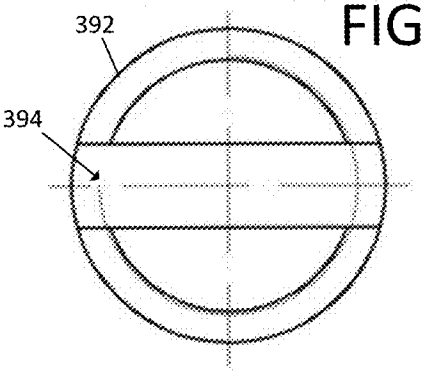
Figure 7C:
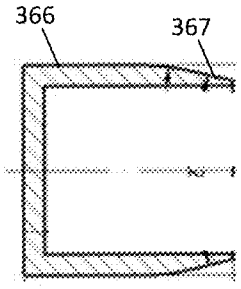
Figure 7D:
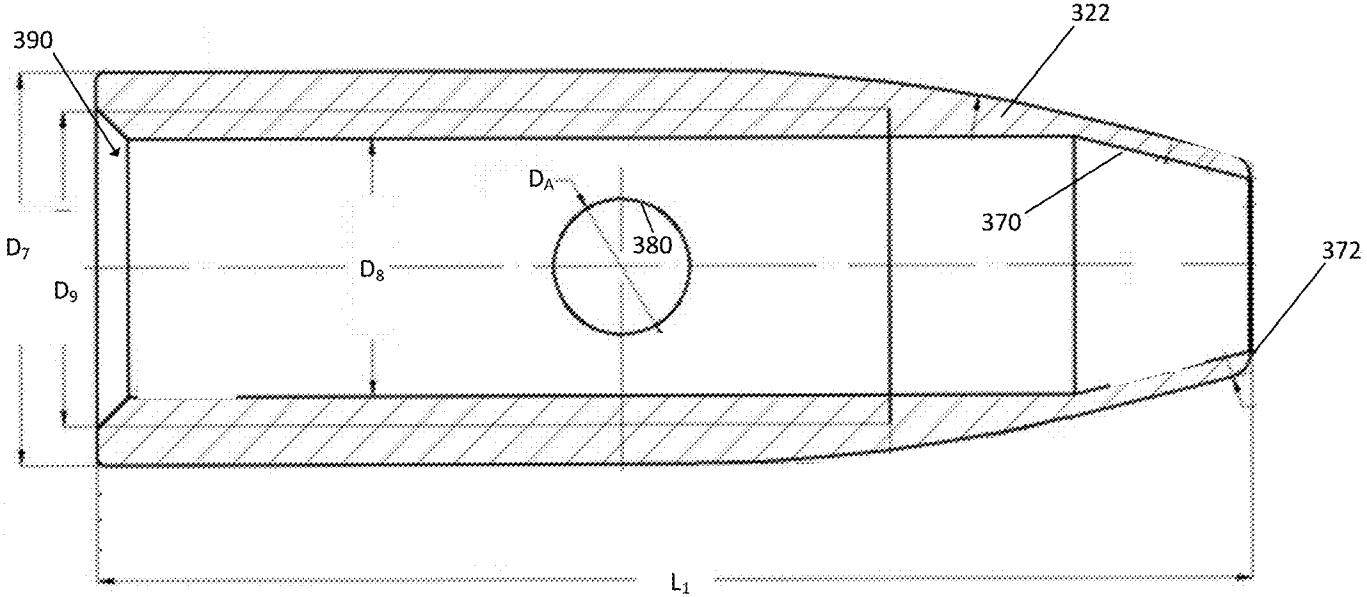
Figure 7E:
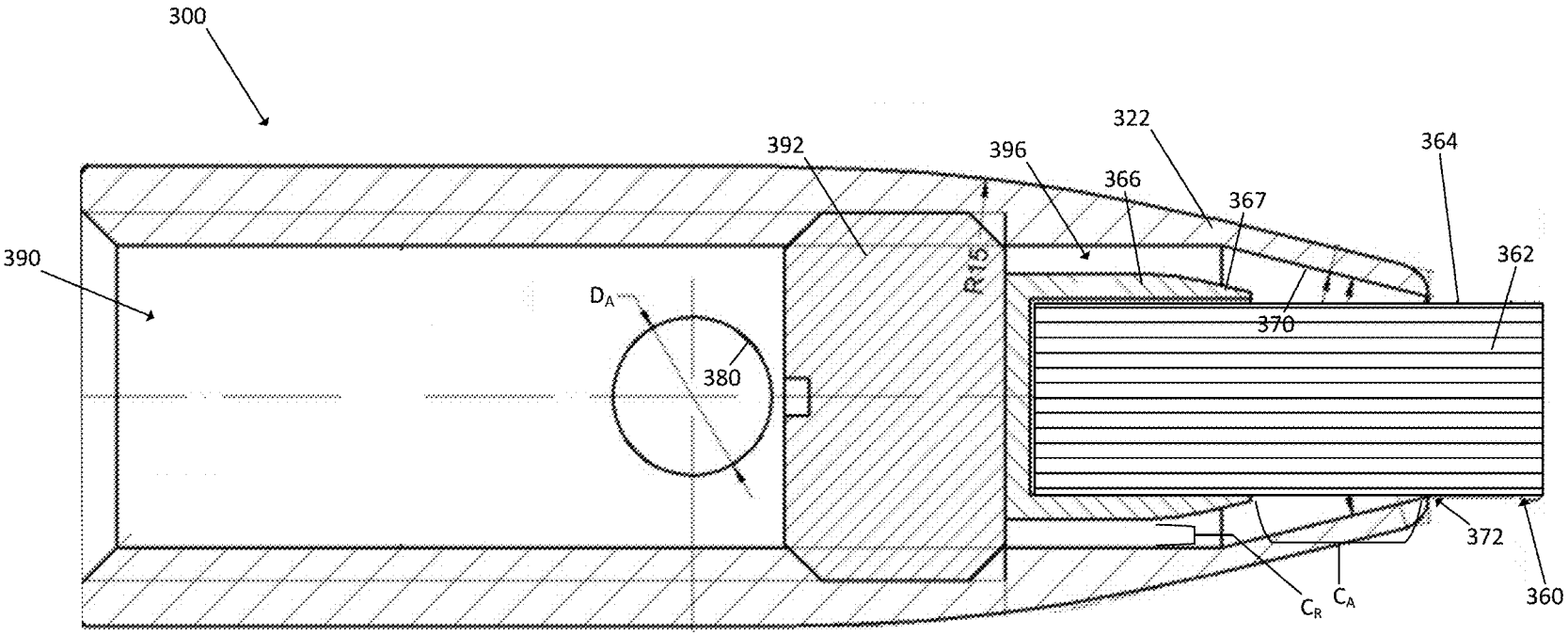

The connector member 322 may swivel or rotate with respect to the cable 360 about a longitudinal axis of the connector member 322, i.e., an axis extending along the center of the bore 390. For example, as illustrated in FIG. 7E, the end of the cable 360 may be received within the connector member 322. The connector member 322 may have an end bore 372 that is larger than the outer diameter of the cover portion 364, such that the cable 360 generally may rotate freely within the connector member 322. The cable 360 may have an enlarged portion or bulb provided by a cable end 366 that is fixed to the end of the cable 360. The cable end 366 may have a diameter larger than that of the bore 372, thereby preventing the cable 360 from being pulled out of the connector member 322. More particularly, an interior surface of the connector member 322 may define a radially extending surface 370 which engages against the cable end 366 when the cable 360 is pulled outwardly from the bore 372. For example, as best seen in FIG. 7E, the cable end 366 may have an outer surface 367 that extends radially, which abuts the radially extending surface 370 of the connector member 322 to prevent axial movement of the cable 360 that would withdraw the cable 360 from the bore 372. Accordingly, the radially extending surface 367 corresponds to the radially extending surface 370 of the connector member 322, and abuts the radially extending surface 370 to prevent axial withdrawal of the cable 360 from the bore 372.

The connector member 322 also has a stopper 392 which generally limits axial insertion of the cable 360 into the bore 372. In the example illustrated, the stopper 392 is provided with a threaded outer surface that corresponds to the threaded end bore 390. Accordingly, the stopper 392 may be mated with the end bore 390 and installed to the bottom of the end bore 390, i.e., by rotating the stopper 392 relative to the connector member 322 until the threaded engagement between the stopper 392 to the bottom (to the right in FIG. 7E) of the threaded end bore 390. The stopper 392 may thus be threaded to the bottom of the threaded end bore 390, and is preventing from further axial movement into the bore 390 by the end of the threads of the connector member 322. The stopper 392 may include a slot 394 to facilitate turning with a screwdriver or other tool. Any other feature may be formed in the stopper 392 to facilitate threading the stopper 392 into the bore 390. Upon installation of the stopper 392 into the connector member 322 and threading of the stopper 392 at least partially into the bore 390, the stopper 392 generally cooperates with the interior of the connector member 322 to form an interior cavity 396 that generally encloses the cable end 366. The cable end 366 may have a small clearance with respect to the inner surfaces of the cavity 396, thereby allowing the cable 364 to remain generally freely rotatable within the connector member 322 while the cable end 366 is retained within the connector member 322. Accordingly, the connector member 322 may generally swivel about its longitudinal axis with respect to the cable 360 even though the cable end 366 remains securely retained within the cavity 396. The cavity 396 may define an axial clearance and/or a radial clearance with respect to the cable end 366. For example, as best seen in FIG. 7E, the cable end 366 is shown abutted against the end stopper 392, but an axial clearance CA permits the cable end 366 to move axially away from the end stopper 392 within the cavity 396, and toward the end bore 372. Additionally, as also seen in FIG. 7E, the cable end 366 has a relatively small radial clearance CR with respect to radially inwardly facing surfaces of the connector member 322, with the radial clearance extending circumferentially about the cable end 366. The cable end 366 may therefore be axially and/or radially movable within the cavity 396, at least to a small degree that facilitates swiveling of the connector member 322 with respect to the cable 360.

The cable 360 may be installed into the connector member 322 in any manner that is convenient. In one example, the metal cable 362 and cover portion 364 are initially assembled, and inserted into the bore 372. The metal cable 362/cover portion 364 are inserted further through the connector member 322, with the inserted end of the metal cable 362 and cover portion 364 protruding out of the threaded end bore 390 of the connector member 322. The cable end 366 may then be secured onto the end of the metal cable 362/cover portion 364, e.g., by crimping, press fitting, bonding, or any other manner that is convenient. The cable 360 may then be retracted into the connector member 322, and the stopper 392 installed into the threaded end bore 390. Conveniently, the cable 360 may be disassembled from the connector member 322 by reversing the foregoing process, e.g., by unthreading the end stopper 392 from the connector member 322, and withdrawing the cable 360 from the connector member 322 (and/or removing or destroying the cable end 366).

As noted above, the connector member 322 may be employed as a component of an interchangeable needle set. In other words, a variety of different length/diameter needle members (not shown) may be selectively assembled to both connector members 322 to form different size/diameter circular knitting needles. However, application of the concepts described herein is not limited to interchangeable needles.

In an example, the connector members 322 are each formed of a metallic material, such as stainless steel. The end stopper 392 may also be formed of a metallic material, such as stainless steel. The cable end 366 may be formed of any material that is convenient, such as a nylon or other plastic material, or a metallic material such as stainless steel, merely as examples.

Figure 8B:
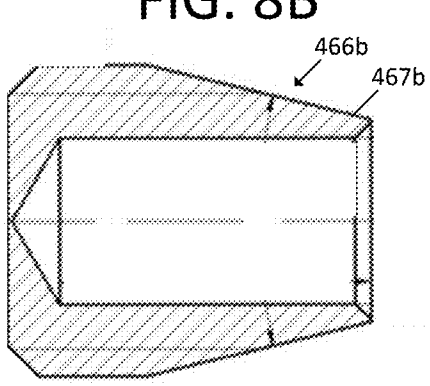
FIGS. 8A-8F illustrate a knitting needle assembly, according to another example, where.
Figure 8A:
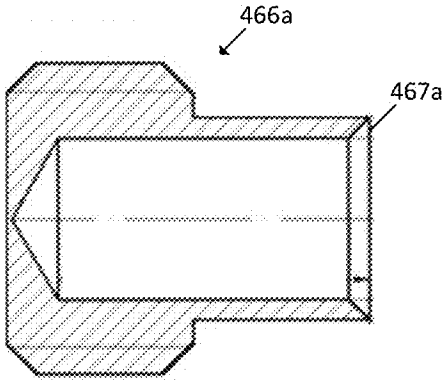
Figure 8C:
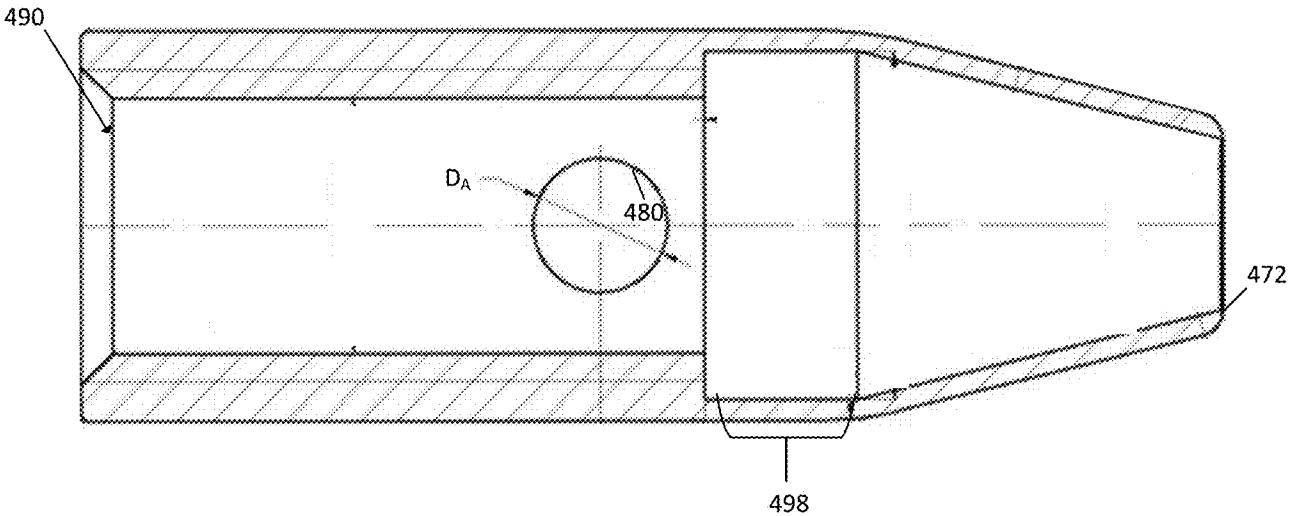
Figure 8D:
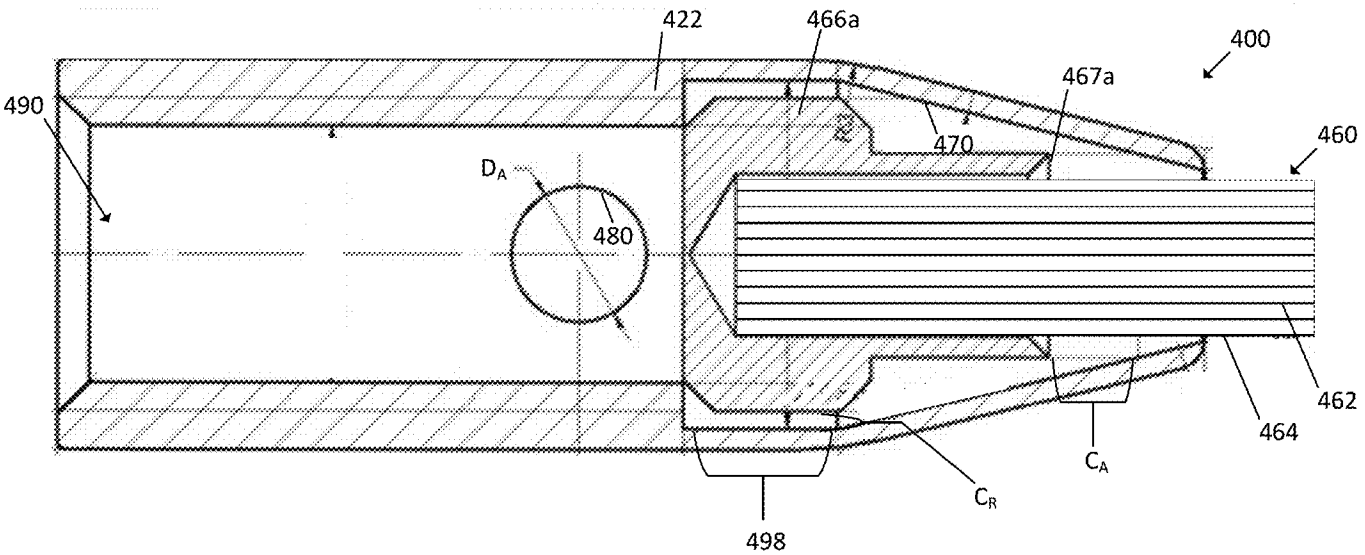
Figure 8E:
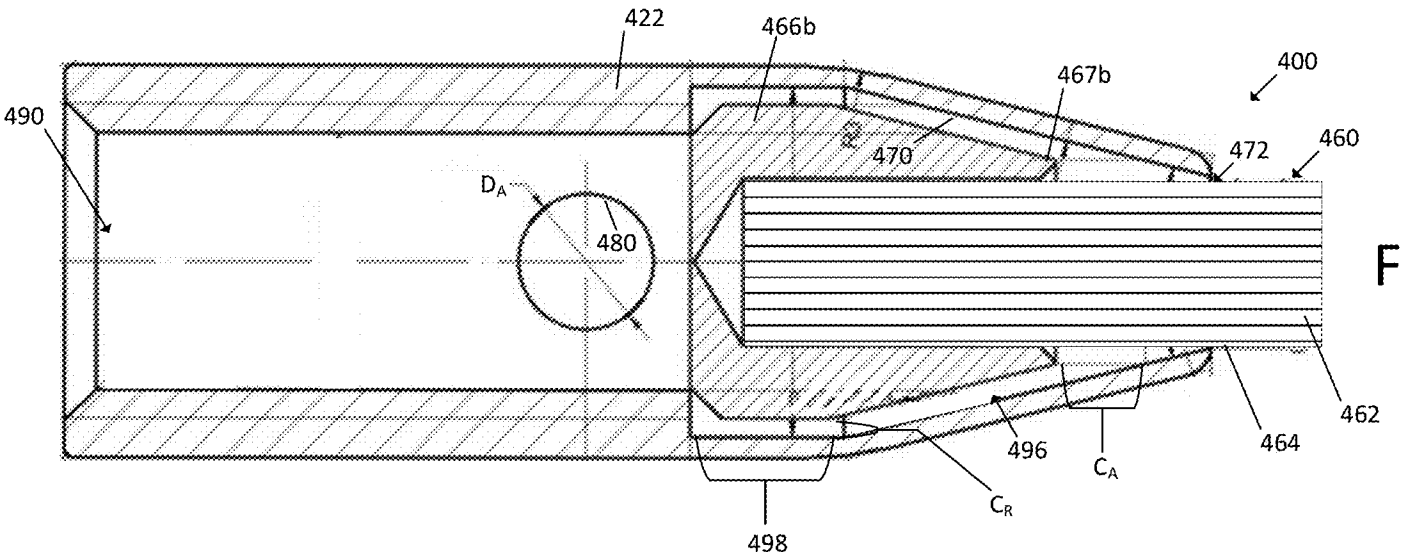

Turning now to FIGS. 8A, 8B, 8C, 8D, and 8E, another knitting needle assembly 400 is illustrated. Knitting needle assembly 400 is substantially identical to the assembly 300 illustrated in FIGS. 7A-7E, with like numerals indicating like features. In contrast to the assembly 300, the assembly 400 has a single-piece threaded cable end 466*a* (as illustrated in FIGS. 8A/8D) or 466*b* (as illustrated in FIGS. 8B/8E) that is secured at an end of a cable 460, instead of the generally two-piece stopper 392 and cable end 366 of the assembly 300. The cable ends 466*a*, 466*b* (collectively, 466) retain an end of their respective cables 460 within a connector member 422. The cable end 466*a* defines a generally cylindrical outer surface and radially extending end face 467*a*. In contrast, the cable end 466*b* is illustrated as having a generally conical radially extending outer surface 467*b* that is aligned parallel, or substantially so, with respect to a radially inwardly facing surface of the connector member 422 in the cavity 496, as best seen in FIG. 8E.

As with the foregoing examples, while not illustrated in FIGS. 7A-7E an opposite end of cable 460 may have another connector member identical to connector member 422. The connector member(s) 422 may be fixed to a needle having a tip, or may have a needle formed at an end opposite that secured to the cable 460. Thus, the knitting needle assembly 400 may be used for knitting as a circular knitting needle, crochet, etc.

The connector member 422 illustrated in FIGS. 8C, 8D, and 8E is illustrated with a radially enlarged interior portion 498 adjacent a threaded end bore 490, in contrast to the connector member 322 described above. The radially enlarged interior portion 498 may be characterized by a relatively larger diameter perpendicular to the axis of the connector 422, compared with the bore 490 and/or thread defined within the bore 490. The end stopper 466 may be threaded through the end bore 490 and into a cavity 496 of the connector member 422. Accordingly, the metal cable 462 and cover portion 464 may be initially assembled, and inserted into the bore 472 of the connector member 422. The metal cable 462/cover portion 464 may be inserted further through the connector member 422, with the inserted end of the metal cable 462 and cover portion 464 protruding out of the threaded end bore 490 of the connector member 422. The one-piece cable end 466 may then be secured onto the end of the metal cable 462/cover portion 464, e.g., by crimping, press fitting, bonding, or any other manner that is convenient. The cable 460 may then be retracted into the connector member 422. The cable end 466 may include threads along a radially outer surface thereof, and thus may be threaded along the end bore 490. The threads of the connector member 422 may continue to the axial edge of the bore 490, such that the end stopper 466 reaches the cavity 496 of the connector member 422 (see FIGS. 8D and 8E). The cable end 466 may then be generally free within the cavity 496 of the connector member 422 to rotate relative to the connector member 422. At the same time, a larger outer diameter of the cable end 466 in relation to the smaller bore 472 of the connector member 422 may prevent axial withdrawal of the cable end 466 from the connector member 422. Further, the cable end 466 may generally be prevented from being inserted into the threaded bore 490 by interference between the threads of the end stopper 466 and the threads of the bore 490. At the same time, the mating threads of the cable end 466 and connector member 422 may be aligned and re-engaged, and the cable end 466 may be rotated relative to the connector member 422 and threaded back through the end bore 490 to remove the cable end 466 from the connector member 422. Additionally, the cable end 466 may be generally fixed to the end of the cable 460 for rotation therewith, and thus may be turned relative to the connector member 422 by manipulating the cable 460. Accordingly, additional tools are generally not needed to disassemble the cable end 466 and/or cable 460 from the connector member 422.

The cable end 466 may have a relatively small clearance with respect to inner surface(s) of the cavity 496 defined by the connector member 422, thereby allowing the cable 460 to remain generally freely rotatable within cavity 496 of the connector member 422 while the cable end 466 is retained within the connector member 422. Accordingly, the connector member 422 may generally swivel about its longitudinal axis with respect to the cable 460 even though the cable end 466 remains securely retained within the cavity 496.

The cavity 496 may define an axial clearance and/or a radial clearance with respect to the cable end 466, as seen in FIGS. 8D and 8E. For example, in each of FIGS. 8D and 8E, the cable end 466*a*, 466*b* is shown positioned within the cavity 496 where the mating threads of the cable end 466 are disengaged with the threads of the end bore 390. The cable end 466 is thus generally free to move axially toward the end bore 372 within the cavity 396. Additionally, in FIGS. 8D and 8E the cable end 466 also has a relatively small radial clearance with respect to radially inwardly facing surfaces of the connector member 422, with the radial clearance extending circumferentially about the cable end 466.

In an example, the connector members 422 are each formed of a metallic material, such as stainless steel. The cable ends 466*a*, 466*b* may also be formed of a metallic material, such as stainless steel. In another example, the cable ends 466*a*, 466*b* may be formed of a nylon or other plastic material.

Figure 7F:
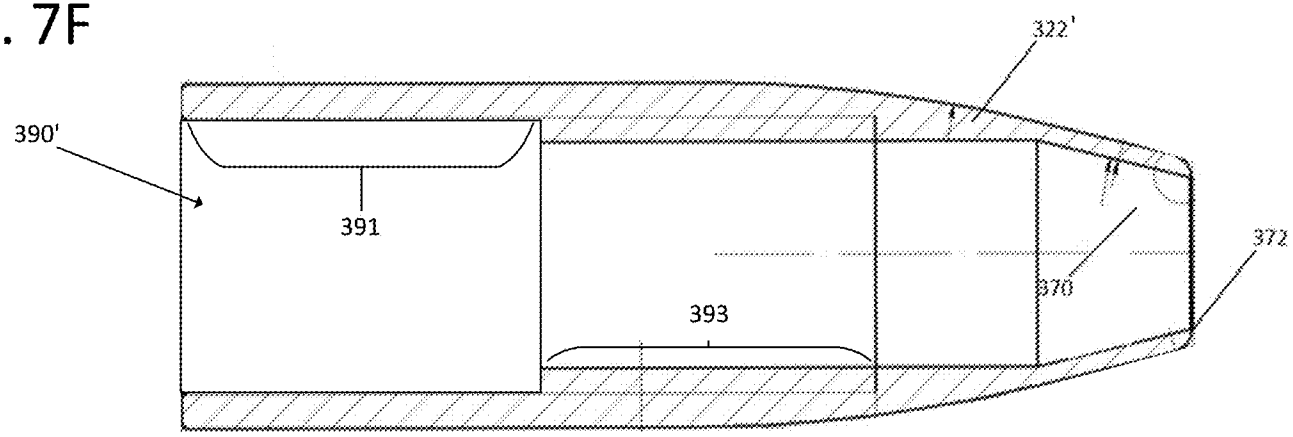
Figure 8F:
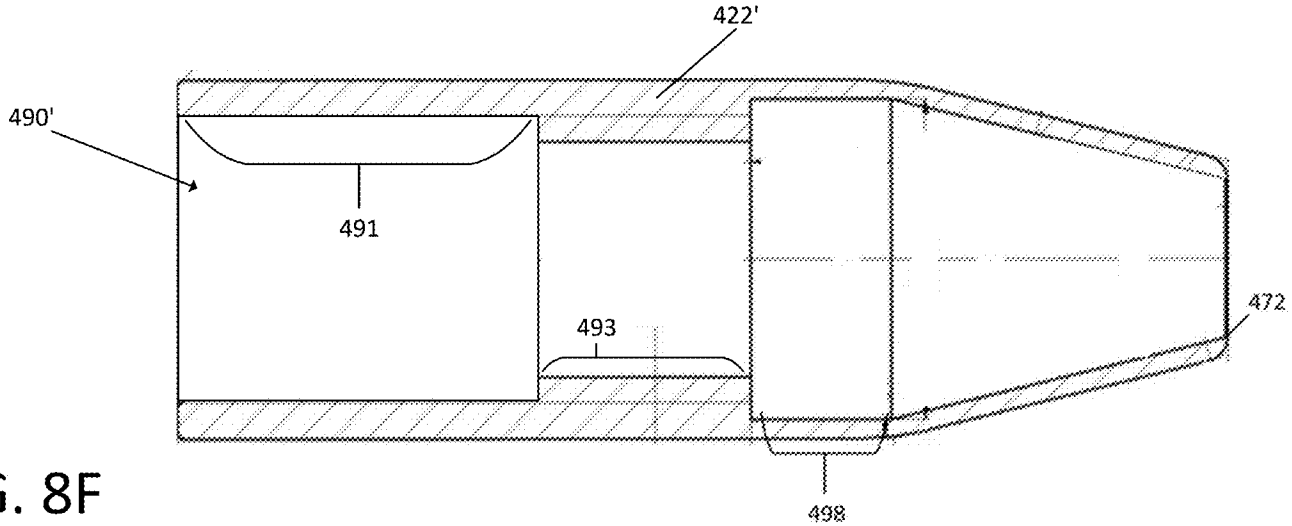

Turning now to FIGS. 7F and 8F, another example of the connector members 322' and 422' are illustrated, respectively. The connector members 322'/422' each have bores 390'/490' that are characterized by an unthreaded portion 391/491. A threaded portion 393/493 of the bores 390'/490' is axially spaced along the connector member 322'/422' with respect to the unthreaded portion 391/491, as seen in FIGS. 7F and 8F. The unthreaded portions 391/491 of the bores 390'/490' may generally facilitate securement of a press-fit needle member within the bores 390'/490'. Accordingly, the connector members 322' and 422' may be convenient for applications directed to a non-interchangeable knitting needle, i.e., where it is not necessary to uninstall/reinstall needle members from the connector members frequently. At the same time, a threaded portion 393/493 of the bores 390'/490' defines a radially inwardly facing thread that allows the securement of an end stopper 392 or cable end 466 in the same manner as described above, e.g., to generally capture a cable end such as the cable end 366 or cable end 466 within the connector member 322'/422'.

Reference in the specification to "one example," "an example," "one embodiment," or "an embodiment" means that a particular feature, structure, or characteristic described in connection with the example is included in at least one example. The phrase "in one example" in various places in the specification does not necessarily refer to the same example each time it appears.

With regard to the processes, systems, methods, heuristics, etc. described herein, it should be understood that, although the steps of such processes, etc. have been described as occurring according to a certain ordered sequence, such processes could be practiced with the described steps performed in an order other than the order described herein. It further should be understood that certain steps could be performed simultaneously, that other steps could be added, or that certain steps described herein could be omitted. In other words, the descriptions of processes herein are provided for the purpose of illustrating certain embodiments, and should in no way be construed so as to limit the claimed invention.

Accordingly, it is to be understood that the above description is intended to be illustrative and not restrictive. Many embodiments and applications other than the examples provided would be upon reading the above description. The scope of the invention should be determined, not with reference to the above description, but should instead be determined with reference to the appended claims, along with the full scope of equivalents to which such claims are entitled. It is anticipated and intended that future developments will occur in the arts discussed herein, and that the disclosed systems and methods will be incorporated into such future embodiments. In sum, it should be understood that the invention is capable of modification and variation and is limited only by the following claims.

All terms used in the claims are intended to be given their broadest reasonable constructions and their ordinary meanings as understood by those skilled in the art unless an explicit indication to the contrary in made herein. In particular, use of the singular articles such as "a," "the," "said," etc. should be read to recite one or more of the indicated elements unless a claim recites an explicit limitation to the contrary.

What is claimed is:

1. A knitting needle assembly, comprising:

a cable having opposite ends;

first and second cylindrical members, each of the cylindrical members having a respective longitudinal axis extending along a cylindrical body of the respective cylindrical member, the first and second cylindrical members being coupled to first and second cable ends secured to first and second opposite ends of the cable, respectively;

wherein at least one of the first and second cylindrical members is coupled to its respective cable end such that the cable end is enclosed within a cavity defined in part by the cylindrical member, the cavity defining a clearance about at least a portion of the cable end such that the cylindrical member swivels about its longitudinal axis with respect to the cable to permit relative rotation between the respective cylindrical member and the cable while axially and radially retaining the cable end within the cavity.

2. The knitting needle assembly of claim 1, wherein the at least one of the first and second cylindrical members defines a radially extending surface preventing withdrawal of the respective cable end from the cylindrical member by abutting a corresponding radially extending surface of the respective cable end.

3. The knitting needle assembly of claim 2, wherein the radially extending bore surface is configured to engage a corresponding radially extending cable surface, thereby preventing axial withdrawal of the cable from the bore.

4. The knitting needle assembly of claim 1, wherein the cylindrical member is a connector member.

5. The knitting needle assembly of claim 1, wherein the cylindrical member is configured to be secured to a needle member.

6. The knitting needle assembly of claim 1, wherein the cable includes a thread along a radially outer surface, the thread configured to mate with a radially inwardly facing thread defined by the connector member.

7. The knitting needle assembly of claim 6, wherein the thread is defined by one of an end stopper secured to the cylindrical member or a cable end of the cable.

8. The knitting needle assembly of claim 7, wherein the one of the end stopper or the cable end is selectively removable from the connector member.

9. The knitting needle assembly of claim 1, wherein the cylindrical member defines a first end bore receiving the cable, and a second end bore defining a radially inwardly facing thread configured to mate with a radially outer facing thread of the cable.

10. The knitting needle assembly of claim 9, wherein the second end bore includes an unthreaded portion axially spaced from the radially inwardly facing thread of the second end bore.

11. The knitting needle assembly of claim 1, wherein the cable end is radially movable within the cavity.

12. The knitting needle assembly of claim 1, wherein the cable end is axially movable within the cavity.

13. A knitting needle assembly, comprising:

a cable having opposite ends;

first and second cylindrical members, each of the cylindrical members having a respective longitudinal axis extending along a cylindrical body of the respective cylindrical member, the first and second cylindrical members being coupled to first and second cable ends secured to first and second opposite ends of the cable, respectively;

wherein at least one of the first and second cylindrical members is coupled to its respective cable end such that the cylindrical member swivels about its longitudinal axis with respect to the cable to permit relative rotation between the respective cylindrical member and the cable while retaining the cable end; and wherein the at least one of the first and second cylindrical members defines a first end bore receiving the cable, and a second end bore at an opposite end thereof, the second end bore defining a radially inwardly facing thread configured to mate with a radially outwardly facing thread of the cable.

14. The knitting needle assembly of claim 13, wherein the at least one of the first and second cylindrical members defines a radially extending surface preventing withdrawal of the respective cable end from the cylindrical member by abutting a corresponding radially extending surface of the respective cable end, wherein the radially extending bore surface is configured to engage a corresponding radially extending cable surface, thereby preventing axial withdrawal of the cable from the bore.

15. The knitting needle assembly of claim 13, wherein the cylindrical member is configured to be secured to a needle member.

16. The knitting needle assembly of claim 13, wherein at least one of the first and second cylindrical members is coupled to its respective cable end such that the cable end is enclosed within a cavity defined in part by the cylindrical member.

17. The knitting needle assembly of claim 16, wherein the cavity defines a clearance about at least a portion of the cable end.

18. The knitting needle assembly of claim 13, wherein the second end bore includes an unthreaded portion axially spaced from the radially inwardly facing thread of the second end bore.

19. The knitting needle assembly of claim 1, wherein the cable is a braided metal cable including a plurality of metal braids surrounded by a cover portion, the cover portion formed of a non-metallic material.

20. The knitting needle assembly of claim 13, wherein the cable is a braided metal cable including a plurality of metal braids surrounded by a cover portion, the cover portion formed of a non-metallic material.

* * * * *